US010103496B2

(12) United States Patent
Fabre et al.

(10) Patent No.: US 10,103,496 B2
(45) Date of Patent: Oct. 16, 2018

(54) ELECTRIC CONNECTOR WITH SHIELD CONTACT

(71) Applicant: Delphi International Operations Luxembourg S.A.R.L., Bascharage (LU)

(72) Inventors: Jean Fabre, Chartres (FR); Frederic Belliard, Saint-Remy-l'Honore (FR)

(73) Assignee: Delphi International Operations Luxembourg, Sarl, Luxembourg (LU)

( * ) Notice: Subject to any disclaimer, the term of this patent is extended or adjusted under 35 U.S.C. 154(b) by 237 days.

(21) Appl. No.: 15/031,874

(22) PCT Filed: Nov. 6, 2014

(86) PCT No.: PCT/EP2014/073948
§ 371 (c)(1),
(2) Date: Apr. 25, 2016

(87) PCT Pub. No.: WO2015/071171
PCT Pub. Date: May 21, 2015

(65) Prior Publication Data

US 2016/0268738 A1 Sep. 15, 2016

(30) Foreign Application Priority Data

Nov. 12, 2013 (FR) ..... 13 61008

(51) Int. Cl.
*H01R 13/648* (2006.01)
*H01R 13/52* (2006.01)
(Continued)

(52) U.S. Cl.
CPC ..... *H01R 13/648* (2013.01); *H01R 9/0527* (2013.01); *H01R 13/5205* (2013.01);
(Continued)

(58) Field of Classification Search
CPC ..... H01R 13/648; H01R 13/5205; H01R 13/6596
See application file for complete search history.

(56) References Cited

U.S. PATENT DOCUMENTS 5,691,506 A 11/1997 Miyazaki et al.
5,971,811 A 10/1999 Mori et al.
(Continued)

FOREIGN PATENT DOCUMENTS

CN 102170074 A 8/2011
CN 202308634 U 7/2012
(Continued)

*Primary Examiner* — Briggitte R Hammond
(74) *Attorney, Agent, or Firm* — Robert J. Myers

(57) ABSTRACT

The invention relates to an electric connector with a shield contact. This connector comprises a sleeve with a cavity designed to receive the end of at least one cable provided with a first contact and a shielding ferule, and an outer surface. This connector also comprises a metal shield contact ring having at least one inner elastic tongue extending toward the inside of the cavity to establish an electric contact with the ferule, and at least one outer elastic tongue extending toward the outside of the outer surface to establish an electric contact with the shield of a counter-connector or a housing incorporating a counter-connector having a second contact connected to the first contact, when the connector and the counter-connector are coupled.

11 Claims, 2 Drawing Sheets

(51) Int. Cl.
*H01R 9/05* (2006.01)
*H01R 13/6596* (2011.01)
*H01R 13/74* (2006.01)

(52) U.S. Cl.
CPC ..... *H01R 13/6596* (2013.01); *H01R 13/5202* (2013.01); *H01R 13/748* (2013.01)

(56) References Cited

U.S. PATENT DOCUMENTS

| | | | | |
|---|---|---|---|---|
| 6,053,749 | A | 4/2000 | Masuda et al. | |
| 8,602,797 | B2 * | 12/2013 | Omae | H01R 13/6592 439/99 |
| 9,257,796 | B1 * | 2/2016 | Dang | H01R 9/035 |
| 2004/0266230 | A1 | 12/2004 | Chiran et al. | |
| 2009/0058759 | A1 * | 3/2009 | Morikawa | H01P 5/085 343/906 |
| 2009/0093170 | A1 | 4/2009 | Shinkawa et al. | |
| 2010/0055982 | A1 * | 3/2010 | Suzuki | H01R 9/032 439/625 |
| 2011/0195603 | A1 | 8/2011 | Fujiwara et al. | |
| 2013/0029524 | A1 * | 1/2013 | Omae | H01R 4/34 439/607.01 |
| 2015/0004826 | A1 * | 1/2015 | Starke | H01R 4/4872 439/345 |

FOREIGN PATENT DOCUMENTS

| | | | |
|---|---|---|---|
| DE | 19822015 | A1 | 11/1998 |
| DE | 19829291 | A1 | 2/1999 |
| EP | 1429427 | A1 | 6/2004 |
| JP | 05251116 | A | 9/1993 |
| WO | 03206077 | A1 | 3/2003 |

* cited by examiner

ELECTRIC CONNECTOR WITH SHIELD CONTACT

CROSS-REFERENCE TO RELATED APPLICATIONS

This application is a national stage application under 35 U.S.C. § 371 of PCT Application Number PCT/EP2014/073948 having an international filing date of Nov. 6, 2014, which designated the United States, said PCT application claiming the benefit of priority under Article 8 of the Patent Cooperation Treaty to French Patent Application No. 136108, having a filing date of Nov. 12, 2013, the entire disclosure of each of which are hereby incorporated herein by reference.

TECHNICAL FIELD OF THE INVENTION

The invention relates to the field of electric connectors, for example electric power connectors, and notably electric power connectors for electric or hybrid motor vehicles.

BACKGROUND OF THE INVENTION

Electric power connectors are used in electric or hybrid motor vehicles, for example for interconnecting a set of batteries with an electric motor, with a power converter, or the like.

In hybrid and electric vehicles, the electric currents transmitted by the cables and connectors of the electric power circuits are relatively high, and may be as much as 600 amperes, or even 1500 amperes at current peaks. Consequently, the electric power carried through the electric cables and connectors can generate electromagnetic interference. It is therefore important to limit this electromagnetic interference as much as possible. For this purpose, shielding is used on the cables, as well as on the connectors.

BRIEF SUMMARY OF THE INVENTION

One object of the invention is to provide shielding which is simple and economical to manufacture and to assemble in a connector.

This object is at least partially achieved by means of a shield contact ring designed for a connector assembly comprising a connector, a counter-connector and a shield wall. The connector is designed to be fitted on the shield wall. The shield wall is, for example, an electrically conductive wall of a casing in which the counter-connector is fitted. The connector comprises a sleeve made of electrically insulating material. At least a first contact is housed in this sleeve. It is attached to the end of a cable, by clamping or soldering for example. This cable is also equipped with a shielding sheath, formed by a flexible conductive braid for example. The counter-connector comprises at least one second contact designed to be connected to the first contact. The shield contact ring then comprises an inner portion, located inside the sleeve and electrically linked to the shielding sheath of the cable, and an outer portion located on the outside of the sleeve, made in one piece with the inner portion, and electrically linked to the shield wall.

Thus the shield contact ring is formed by a single element which provides electrical continuity, and therefore continuity of shielding, between the shielding sheath of the cable and the casing. By limiting the number of elements providing this continuity of shielding to one only, the efficiency of the shielding is increased and the manufacture and assembly of the device providing this function is simplified, thereby making the device more economical.

At least one of the inner and outer portions of the shield contact ring may comprise at least one resilient tongue in order to optimize the electric conduction on the shielding sheath of the cable and/or on the shield wall.

Additionally, in some environments, and notably outside the passenger compartments of vehicles, water tightness is required.

The connector may then comprise a support made of electrically insulating material, extending radially around and outside the sleeve, for example substantially perpendicularly to the longitudinal axis of the sleeve. This support is attached to the shield wall and can thus be used to fasten the connector to the casing in which the counter-connector is fitted. An interface gasket is placed between the support and the shield wall, around the sleeve and the outer portion of the shield contact ring. A cable gasket is also placed around the cable, inside the sleeve and on the other side of the first contact from the inner portion of the shield contact ring. Thus a seal is provided between the connector and the casing, while keeping the shield contact ring in a sealed area.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1:
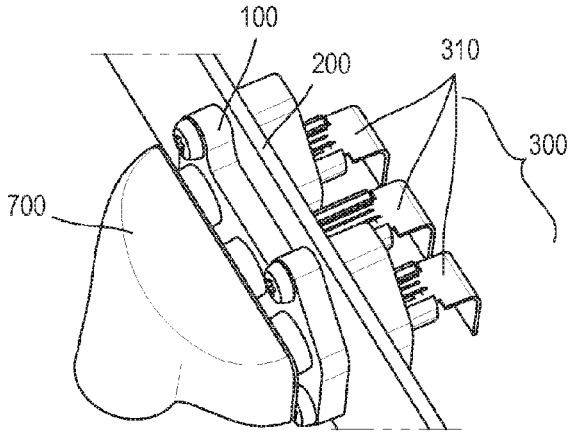
FIG. 1 shows schematically, in perspective, an exemplary embodiment of a connector assembly according to the invention.

An example of a connector assembly is shown in FIG. 1. This example relates to a connector 100 fitted on the shield wall 200. This shield wall 200 is a wall of a power device such as a power converter or an electric motor. A counter-connector 300, in this case taking the form of a busbar which is partially illustrated, is fitted in the power device. It has one or more contacts 310, which in the case described here are male contacts.

Figure 2:
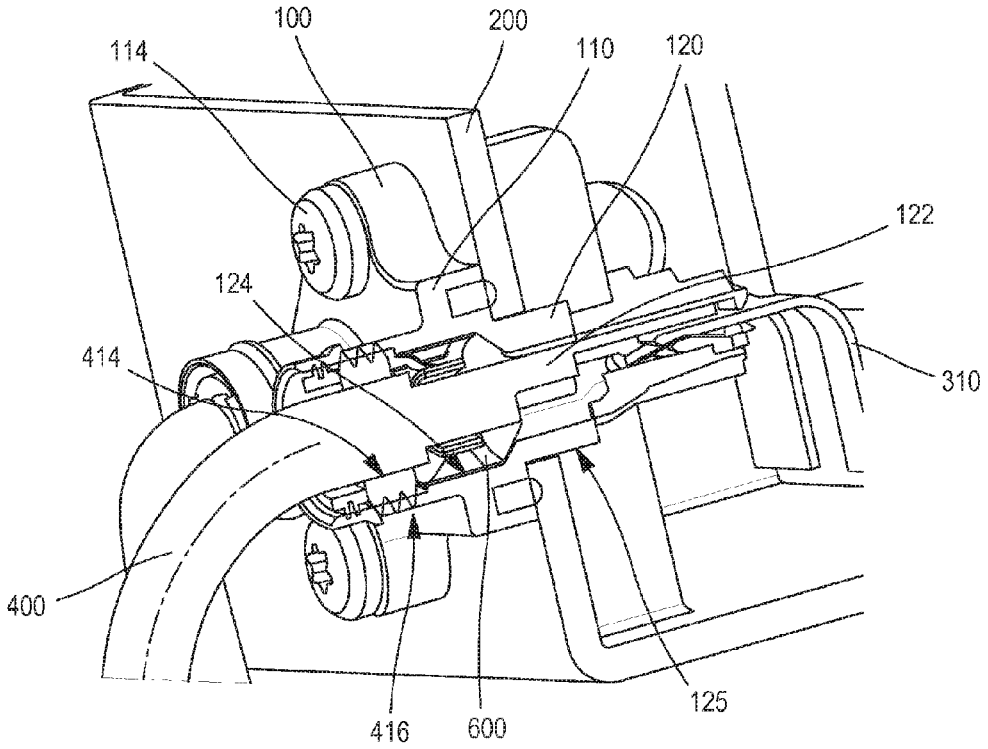
FIG. 2 shows schematically, in perspective and in longitudinal section, the connector assembly of FIG. 1, without its protective cover.
Figure 3:
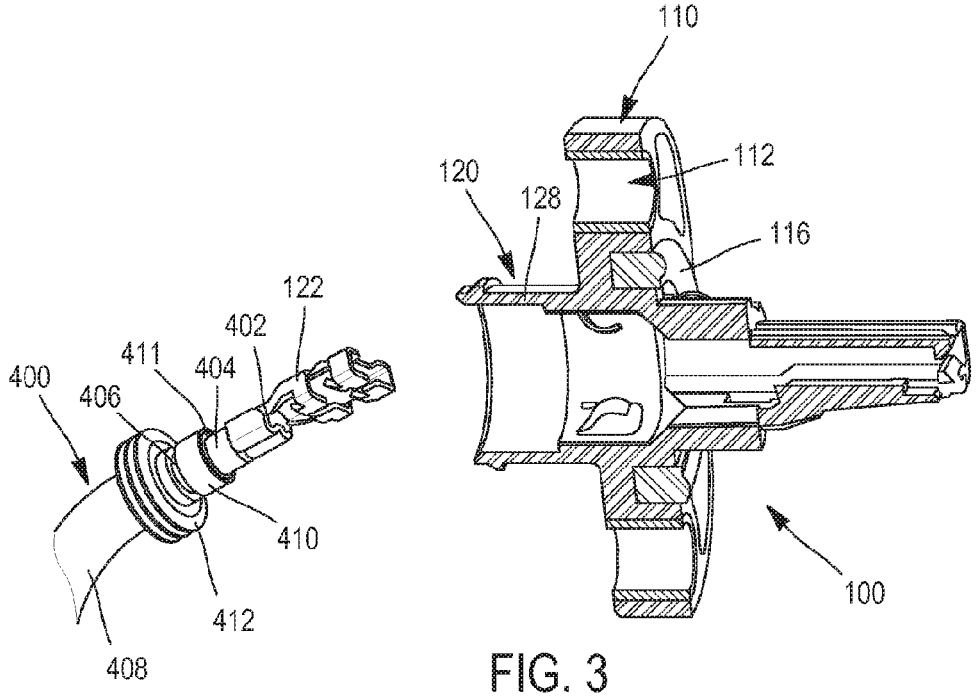
FIG. 3 shows schematically, in perspective and in longitudinal section, a connector assembly according to the invention and a cable to be inserted into this set.

As shown in greater detail in FIG. 2, the connector 100 comprises a support 110 in the form of a plate extending substantially perpendicularly to the longitudinal axis of a plurality of sleeves 120 (numbering three in this case) and radially around and outside these sleeves. The support 110 and the sleeves 120 form a single piece, molded in electrically insulating plastic material. The support 110 has through holes 112 (four in this case, for example) for the passage of screws 114 for fastening the connector 100 to the shield wall 200 (see FIG. 3). These holes 112 are reinforced by cylindrical metal bushes.

Each sleeve 120 has an inner surface 124 and an outer surface 125 (see FIG. 2). It also has a portion intended for insertion into the power device on which the connector 100 is fitted, through the shield wall 200, and a portion intended to remain outside this device. Each sleeve 120 receives an electric contact 122. In the chosen example shown in FIG. 3, this electric contact 122 is a female contact. It is clamped onto the stripped end of the core 402 of a cable 400, which also has an inner sheath 404 insulating the core 402 from a shielding sheath 406, and an outer insulating sheath 408 which surrounds the shielding sheath 406. The cable 400 is, for example, a shielded cable with a 16 $mm^2$ cross section. The shielding sheath 406 is itself stripped, in one portion, so that it can slide between an outer ferrule 410 and an inner ferrule 411 and can be clamped there, so that the shielding sheath 406 is pressed between two rigid elements, thereby providing optimal electrical conduction and continuity of shielding. Upstream of the area of clamping on the stripped core 402, the shielding sheath 406 is itself stripped in a portion which receives an electrically conductive outer ferrule 410. Further upstream from the outer ferrule 410, the cable 400 receives a one-piece elastomeric cable gasket 412 comprising, on the one hand, an inner surface 414 forming a seal with the outer insulating sheath 408 of the cable 400 and, on the other hand, an outer surface 416 having lips designed to bear on and make contact with a section of the sleeve 120, thus providing a seal with the inner surface of the sleeve 120 (see FIG. 2). Further upstream from the one-piece cable gasket 412, a retaining ring 500, fitted on the cable 400, is inserted and clipped into the opening of a sleeve 120 designed for the insertion of the cable 400, in order to retain the one-piece cable gasket 412 in this sleeve 120.

Figure 4:
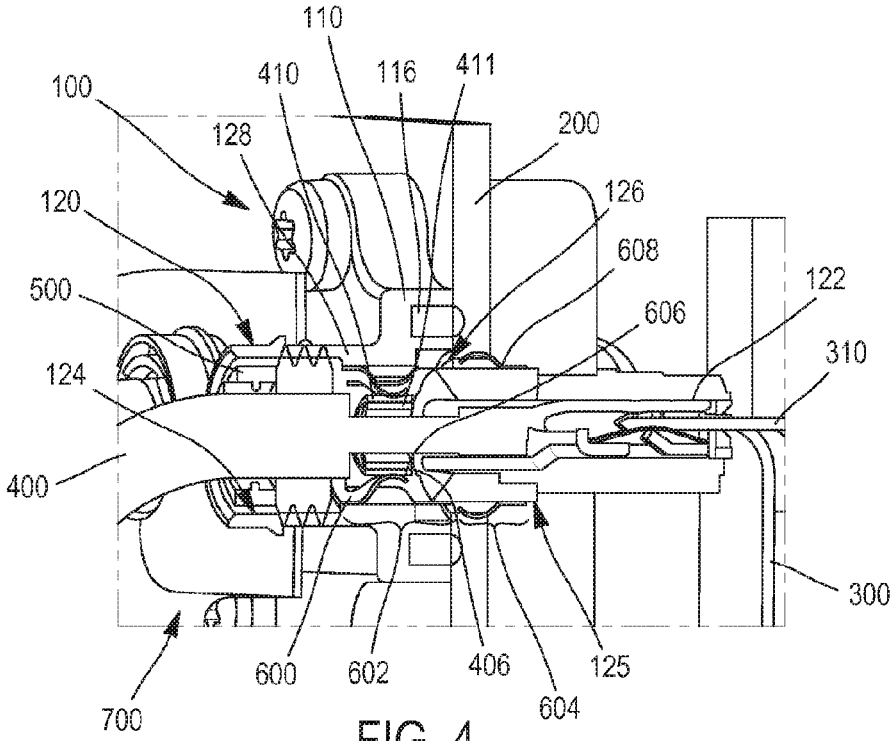
FIG. 4 shows schematically, in perspective and in longitudinal section, the connector assembly of FIGS. 1 and 2, with its protective cover.

Each sleeve 120 also receives a shield contact ring 600 made of electrically conductive material (see FIG. 4). Each shield contact ring 600 is formed by a section of metal strip wound around a longitudinal axis parallel to that of the sleeve 120 in which it is fitted. It is a single component having an inner portion 602 and an outer portion 604 made in one piece with the inner portion 602. The cutting of a section of strip from a sheet of metal and the shaping of this section by winding are therefore particularly simple and inexpensive, notably by comparison with pressing or deep drawing methods.

The inner portion 602 of the shield contact ring 600 is located inside the sleeve 120, in the part of the sleeve designed to remain outside the device on which the connector 100 is fitted. The inner portion 602 of the shield contact ring 600 bears on a section of the inner surface 124 of the sleeve 120, separate from the section of the inner surface 124 of the sleeve 120 in contact with the one-piece cable gasket 412. The inner portion 602 of the shield contact ring 600 is electrically connected to the shielding sheath 406, by means of inner resilient tongues 606 extending toward the inside of the wound section of metal strip and bearing on the outer ferrule 410 to provide an electric contact with the latter. The outer portion 604 of the shield contact ring 600 is located outside the sleeve 120 and is electrically connected, by means of outer resilient tongues 608, to the shield wall 200. The inner resilient tongues 606 are oriented so as to facilitate the insertion of the electric contact 122 and the outer ferrule 410 through the shield contact ring 600. For example, they extend between a fixed end located at the opening in the sleeve 120 designed for the insertion of the cable 400 and a free end located in the part of the sleeve 120 oriented toward the counter-connector 300. The outer resilient tongues 608 are oriented so as to facilitate the insertion of the connector 100 equipped with these tongues through an opening in the shield wall 200. For example, they extend between a fixed end located on the part of the sleeve 120 oriented toward the counter-connector 300 and a free end located at the opening of the sleeve 120 designed for the insertion of the cable 400.

The outer portion 604 of the shield contact ring 600 extends from one edge of the wound metal strip section, and passes through one or more openings 126 formed in the wall 128 of the sleeve 120.

An interface gasket 116 is placed in a channel of the support 110, and projects outside the latter, between the support 110 and the shield wall 200, around one or more sleeves and the outer portion 604 of the shield contact ring 600. This interface gasket 116 therefore provides a seal between the connector 100 and the shield wall 200. This interface gasket 116 may, for example, provide a seal at an excess pressure of one bar, in salt spray tests for 1600 hours. Additionally, since the one-piece cable gasket 412 is placed around the cable 400, inside the sleeve 120 and on the other side of the electric contact 122 from the inner portion 602 of the shield contact ring 600, the shield contact ring 600 is located in a sealed area located between the one-piece cable gasket 412 and the interface gasket 116.

A cover 700 is also clipped onto the support 110 in order to guide the cables 400 at the exit from the connector 100 and prevent direct exposure of the one-piece cable gaskets 412 to liquid projection.

The connector assembly described above has numerous advantages, including:

- direct connection to a busbar through the shield wall 200 without the need for access to the inside of the casing containing this busbar, thus facilitating maintenance;
- electrical connection provided without clamping the cables 400 with screws; and
- a connector 100 which can be fitted at the ends of cables 400 so as to be supplied to a customer ready for fitting.

In the example described above, the shield wall 200 is a wall of a device incorporating the counter-connector 300, but in a variant the shield wall 200 could be a wall of the counter-connector 300 itself, or, even more directly, a shield of this counter-connector 300 in the form of sheet metal or braid. In this case, it is possible to omit a shield wall 200 between the connector 100 and the counter-connector 300.

In yet another variant of the invention, the connector 100 can be used as a cable feed-through, the cable passing through the shield wall 200 with which the shield contact ring 600 forms an electric contact, but the connector 100, when used as a cable feed-through, does not necessarily comprise an electric contact 122, and the end of the cable 400 can be directly clamped or soldered onto a busbar or other device.

The invention claimed is:

1. A connector assembly, comprising:

a connector;

a counter-connector; and a shield wall, wherein the connector includes a first contact housed in a sleeve, made of electrically insulating material, and attached to an end of a cable equipped with a shielding sheath and a shield contact ring made of electrically conductive material, wherein the counter-connector comprises a second contact, and wherein the shield contact ring comprises an inner portion located inside the sleeve and electrically linked to the shielding sheath and an outer portion, located inside the sleeve, made in one piece with the inner portion and electrically linked to the shield wall.

2. The connector assembly as claimed in claim 1, wherein the connector comprises a support of electrically insulating material extending radially around and outside the sleeve and attached to the shield wall, and wherein an interface gasket is placed between the support and the shield wall, around the sleeve and the outer portion.

3. The connector assembly as claimed in claim 1, wherein a cable gasket is placed around the cable, inside the sleeve and on an other side of the first contact from the inner portion of the shield contact ring.

4. The connector assembly as claimed in claim 3, wherein the shield contact ring bears on a first section of the sleeve, and the cable gasket bears on a second section of the sleeve, distinct from the first section of the sleeve.

5. The connector assembly as claimed in claim 1, wherein the inner portion-of the shield contact ring is electrically connected to a ferrule placed around the shielding sheath.

6. The connector assembly as claimed in claim 1, wherein at least one of the inner and outer portions of the shield contact ring comprises at least one resilient tongue.

7. The connector assembly as claimed in claim 1, wherein the shield contact ring is formed by a wound metal strip section.

8. The connector assembly as claimed in claim 7, wherein the outer portion extends from one edge of the wound metal strip section and passes through a wall of the sleeve.

9. A connector, comprising:

a sleeve formed of electrically insulating material, having a wall with an inner surface and an outer surface;

a shield contact ring made of electrically conductive material, wherein the shield contact ring comprises an inner portion, located inside the sleeve and bearing on a first section of the inner surface of the wall of the sleeve, and an outer portion, located outside the sleeve, made in one piece with the inner portion and extending the inner portion through at least one opening formed in the wall of the sleeve.

10. The connector as claimed in claim 9, wherein the shield contact ring is formed by a wound metal strip section, and the outer portion extends from one edge of the wound metal strip section and passes through the opening formed in the wall of the sleeve.

11. The connector as claimed in claim 9, comprising a support of electrically insulating material extending radially around and outside the sleeve, and an interface gasket placed on the support, around the sleeve and the outer portion.

* * * * *